US005864729A

United States Patent [19]

Piccinino, Jr. et al.

[11] Patent Number: 5,864,729

[45] Date of Patent: Jan. 26, 1999

[54] PROCESS TANK HAVING AN ADJUSTABLE PROCESSING PATH LENGTH AND METHOD OF ADJUSTING THE SAME

[75] Inventors: Ralph L. Piccinino, Jr., Rush; Kevin H. Blakely, Rochester, both of N.Y.

[73] Assignee: Eastman Kodak Company, Rochester, N.Y.

[21] Appl. No.: 947,687

[22] Filed: Oct. 9, 1997

[51] Int. Cl.[6] ..... G03D 3/02; G03D 3/08

[52] U.S. Cl. ..... 396/615; 396/617; 396/626; 396/636

[58] Field of Search ..... 396/615, 617, 396/620, 622, 624, 627, 636, 640, 645, 646, 626

[56] References Cited

U.S. PATENT DOCUMENTS

| | | | |
|---|---|---|---|
| 2,133,109 | 10/1938 | Munson | 396/622 |
| 2,169,061 | 8/1939 | Tondreau | 396/627 |
| 2,853,294 | 9/1958 | Woodcock | 396/620 |
| 4,796,041 | 1/1989 | Ishikawa et al. | 396/615 |
| 5,311,235 | 5/1994 | Piccinino, Jr. et al. . | |
| 5,761,563 | 6/1998 | Earle | 396/615 |

*Primary Examiner*—Alan A. Mathews
*Attorney, Agent, or Firm*—David A. Novais; Frank Pincelli

[57] ABSTRACT

A processing assembly includes a processing tank having a processing path through which a photosensitive material to be processed travels. The tank includes a processing path length adjusting mechanism which forms a part of the processing path and is capable of adjusting a length of the processing path between at least a first predetermined length and a second predetermined length which is different than the first predetermined length. This provides for a versatile processing tank that is adjustable between a normal processing path length for normal photoprocessing and a shorter processing path length for processing applications in which a shorter processing path length is sufficient.

20 Claims, 7 Drawing Sheets

PROCESS TANK HAVING AN ADJUSTABLE PROCESSING PATH LENGTH AND METHOD OF ADJUSTING THE SAME

FIELD OF THE INVENTION

The present invention relates to the field of photography, and particularly to a photosensitive material processing apparatus that includes a processing tank with an adjustable processing path length.

BACKGROUND OF THE INVENTION

The processing of photographic material involves a series of steps such as developing, bleaching, fixing, washing and drying. These steps involve the conveyance of a continuous web of film or cut sheets of film or photographic paper sequentially through a series of stations or tanks, with each one containing a different processing liquid appropriate to the processing step at that station.

Conventional processing tanks are of a fixed size and therefore have a fixed processing path length. In some cases, a shorter processing path length or less chemicals are adequate to process photosensitive material. The use of conventional processing tanks having fixed processing path lengths to process photosensitive material in a process in which a shorter processing path length is adequate results in a waste of processing solution, as well as an increased processing time.

SUMMARY OF THE INVENTION

The present invention provides for a processing tank of a processing assembly for processing photosensitive material, in which the processing tank has an adjustable processing path length. The present invention also relates to an apparatus for changing the length of the processing path in a processing tank of a processing assembly, as well as a method of adjusting the length of the processing path for photosensitive material within a processing tank.

With the apparatus and method of the present invention, a processing path within a processing tank is adjustable so as to permit a single processing tank to provide different processing path lengths and variable speeds.

The present invention relates to a processing tank of a processor for processing photosensitive material. The processing tank comprises a processing path through which a photosensitive material to be processed travels; and a processing path length adjusting mechanism which forms a part of the processing path and adjusts a length of the processing path between at least a first predetermined length and a second predetermined length which is different than the first predetermined length.

The present invention also relates to a processing apparatus which comprises a processing section for processing a photosensitive material, with the processing section comprising at least one processing tank containing processing solution therein and a processing path through which the photosensitive material passes; and an adjustment mechanism for controllably changing a length of the processing path so as to selectively provide for a plurality of different predetermined lengths.

The present invention also relates to an apparatus for changing a length of a processing path in a processing tank of a processor which processes photosensitive material. The apparatus comprises a flexible member mounted in a processing tank which forms a part of the processing path, with the flexible member being selectively adjustable to a plurality of positions within the processing tank that each define a different length of the processing path; and an actuating mechanism for moving the flexible member between the plurality of positions.

The present invention also relates to a method of adjusting a length of a processing path for photosensitive material within a processing tank. The method comprises the steps of positioning a flexible member in a processing tank so as to form a part of the processing path; and moving the flexible member to one of a plurality of different predetermined positions along the processing tank so as to change a length of the processing path, wherein each of the pluralities of different predetermined positions defines a different length for the processing path.

DETAILED DESCRIPTION OF THE INVENTION

Figure 1A:
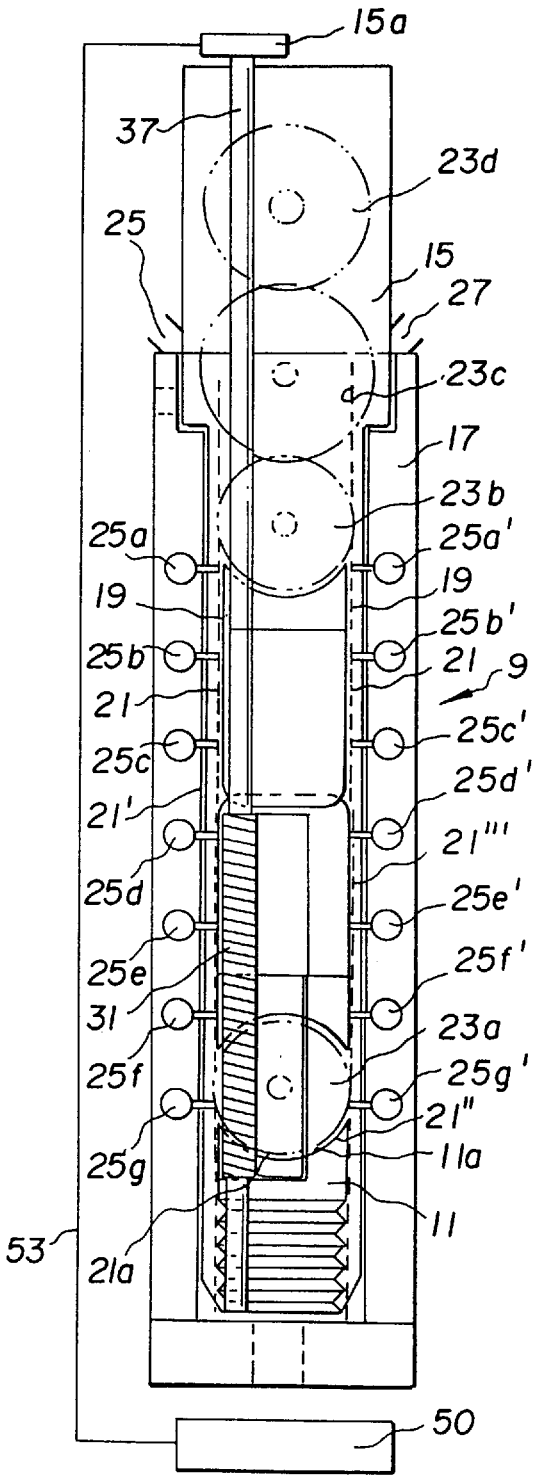
FIGS. 1A and 1B are different views of the processing tank of the present invention which show a processing path length adjusting mechanism in a first position.

Referring now to the drawings, wherein like reference numerals designate identical or corresponding parts throughout the several views, FIG. 1A shows a processing tank 9 having a processing path length adjusting mechanism 11. Processing tank 9 can be for any of the processing steps of a processor as previously discussed. As illustrated in FIG. 1A, processing tank 9 can be of a rack and tank arrangement as described in, for example, U.S. Pat. No. 5,311,235, the subject matter of which is herein incorporated by reference. It is further noted that path length adjusting mechanism 11 can also be applied to a variety of other types of processing tanks.

In the rack and tank type arrangement, a rack 15 can be easily inserted and removed from a tank 17, to form a low volume photosensitive material processing vessel.

When rack 15 is inserted in tank 17, a space 19 which defines a processing path 21 for the passage of photosensitive material is formed. Processing path 21 includes a downward portion 21', a turnaround portion 21" and an upward portion 21'". Rack 15 includes a plurality of rollers 23*a*–23*d* as illustrated in the figure, while tank 17 includes nozzle openings 25*a*–25*g* and 25*a'*–25*g'* which supply processing solution to tank 17. The number of drive rollers and nozzle openings are illustrated as an example, and it recognized that the number of drive rollers and nozzles used are based on design considerations.

As illustrated in FIG. 1A, in addition to drive rollers 23*a*–23*d* rack 15 includes processing path length adjusting mechanism 11 which is operationally connected to and provided adjacent to lowermost drive roller 23*a* so as to define a space 21*a*. Space 21*a* forms a part of the processing path 21 therebetween which is turnaround portion 21". As shown in FIG. 1A, an upper surface 11*a* of processing path length adjustment mechanism 11 is curved to match the curvature of lowermost drive roller 23*a* to form the path of turnaround portion 21".

Tank 17 with rack 15 inserted therein includes an entrance 25 where the photosensitive material enters tank 17 and is conveyed by the drive rollers 23*a*–23*d* along downward portion 21' of path 21. While the photosensitive material is being conveyed, processing solution is supplied to the photosensitive material by way of nozzle openings 25*a*–25*g* and 25*a*'–25*g*'. As the photosensitive material is conveyed to the lowermost drive roller 23*a*, it is transported along turnaround portion 21" between lowermost drive roller 23*a* and upper surface 11*a* of processing path length adjusting mechanism 11 to the upward portion 21'" of processing path 21, and finally to an exit 27.

Figure 2A:
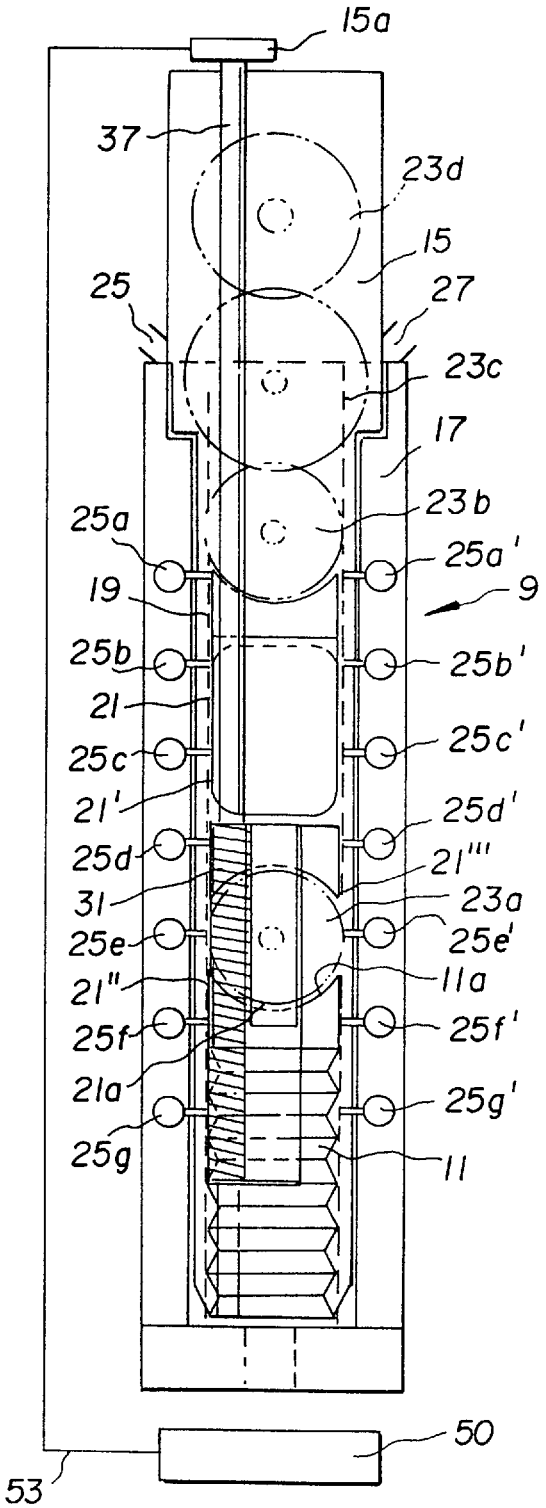
FIGS. 2A and 2B are views similar to FIGS. 1A and 1B which show the processing path length adjusting mechanism in a second position.

The position of processing path length adjusting mechanism 11 illustrated in FIG. 1A forms a normal processing path length. If a photoprocessing operation in which a shortened processing path length is sufficient, then processing path length adjusting mechanism 11 can be moved or expanded to the position shown in FIG. 2A. As illustrated in the embodiment of FIGS. 1A and 2A, processing path length adjusting mechanism 11 can be a flexible member or bellows which is moved or expanded so as to block at least the lower nozzle openings 25*f*, 25*g*, 25*f*, 25*g*' and move turnaround portion 21" upward. This provides for a shortened processing path length as illustrated in FIG. 2A. With the shortened processing path length, during processing, the photosensitive material enters and exits processing tank 17 in the same manner as described with reference to FIG. 1A, however, since the path length adjusting mechanism 11 has been moved or expanded, the processing path length is shortened.

FIG. 2A illustrates the positioning of path length adjusting mechanism 11 to one point in which the lower nozzle openings 25*f*, 25*g*, 25*f*, 25*g*' are blocked. It is recognized that processing path length adjusting mechanism 11 can be moved or expanded to a plurality of positions depending on the length of the desired processing path. For example, it is recognized that processing path length adjusting mechanism 11 could be moved or expanded upwardly so as to block further nozzle openings and provide for an even shorter processing path length. It is further recognized that processing path length adjusting mechanism 11 can be moved or expanded an amount which is less than what is illustrated in FIG. 2A so as to keep the lower nozzle openings open but at the same time provide for a shorter processing path length.

Figure 3:
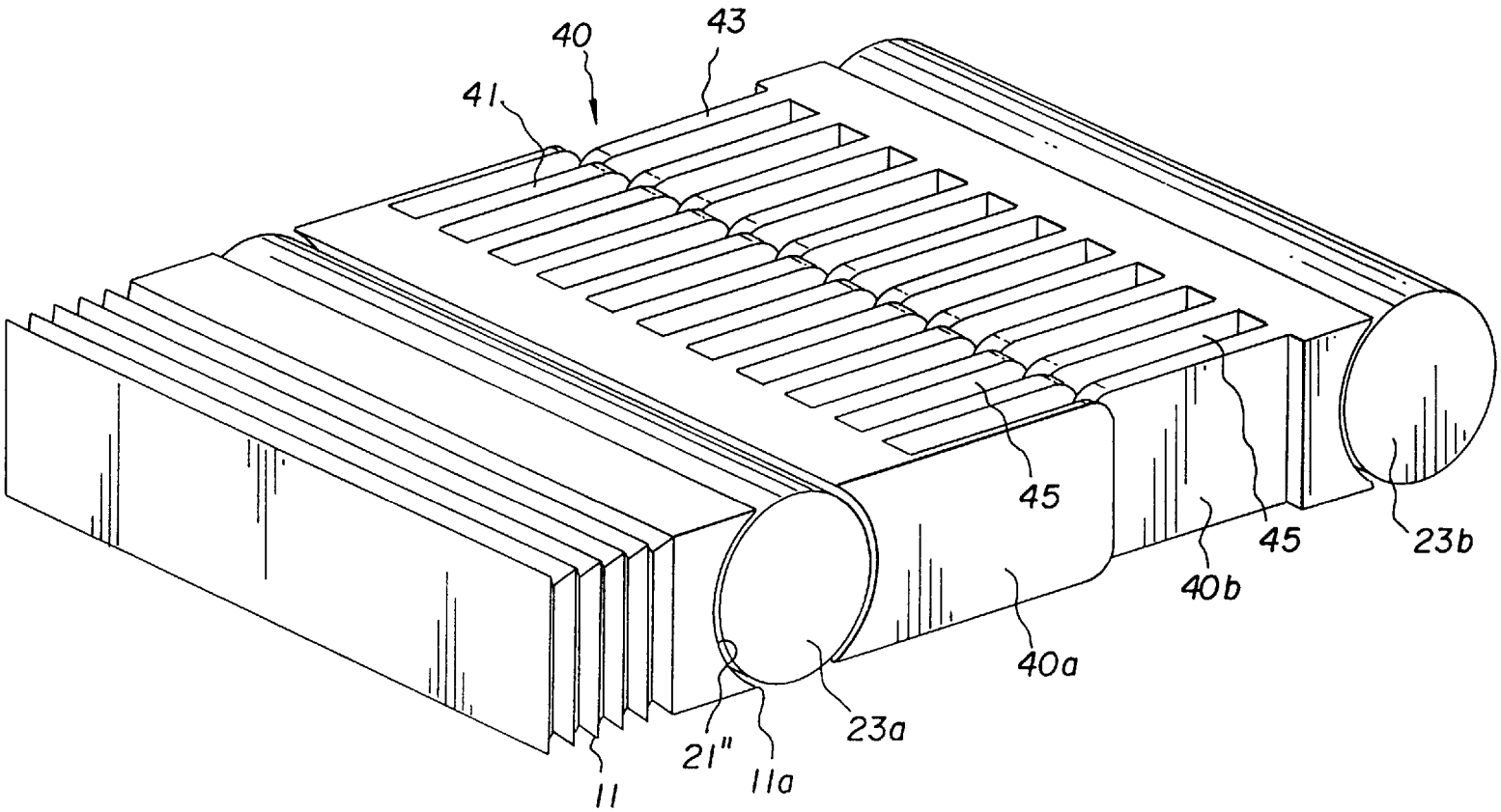
FIGS. 3 and 4 are views of the processing path length adjusting mechanism and a spacer member of the present invention.
Figure 4:
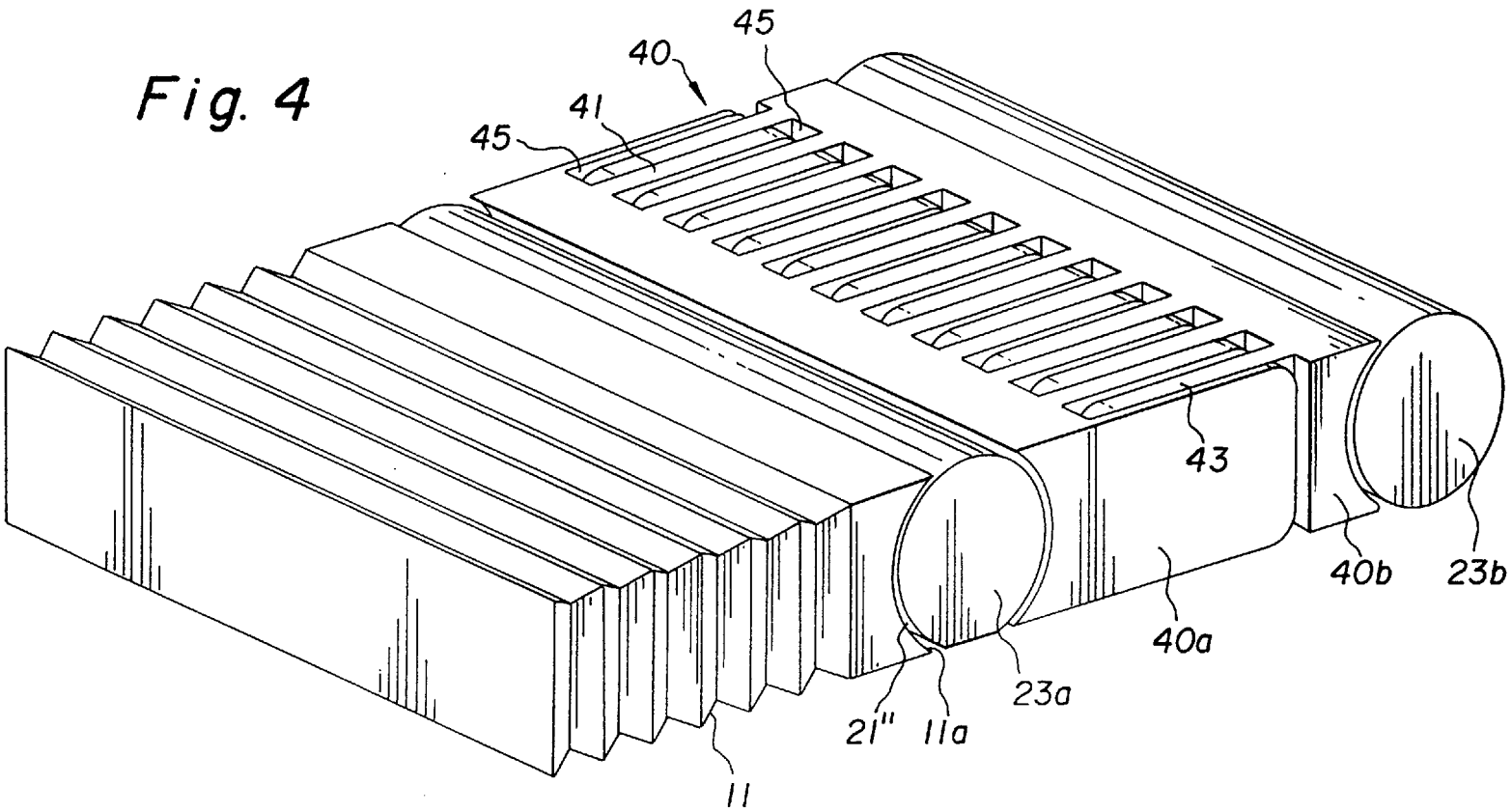

As illustrated in FIGS. 1A–1B and 2A–2B, there is a spacing between drive rollers 23*a* and 23*b* to facilitate the movement or expansion of path length adjusting mechanism 11. In order to insure a uniform processing path 21 and at the same time reduce the volume within tank 17, the present invention can include an intermediate spacer member 40 in the spacing between rollers 23*a* and 23*b*. Intermediate spacer member 40 is illustrated in detail in FIGS. 3 and 4 and comprises a first member 40*a* having a plurality of spaced teeth-like members 41 and a second member 40*b* having a plurality of spaced teeth-like members 43.

The operation with respect to an embodiment of the invention will now be described. As illustrated in the FIGS. 1A and 2A, path length adjusting mechanism 11 can be in the form of an expandable flexible member or bellows. Path length adjusting mechanism 11 can be operationally connected to the lowermost drive roller 23*a*, such that a movement or expansion of path length adjusting mechanism 11 from the position illustrated in FIG. 1A to the position illustrated in FIG. 2A will cause a corresponding movement of drive roller 23*a*; while maintaining spacing 21*a* between drive roller 23*a* and surface 11*a* of path length adjusting mechanism 11 which defines turnaround portion 21".

Figure 1B:
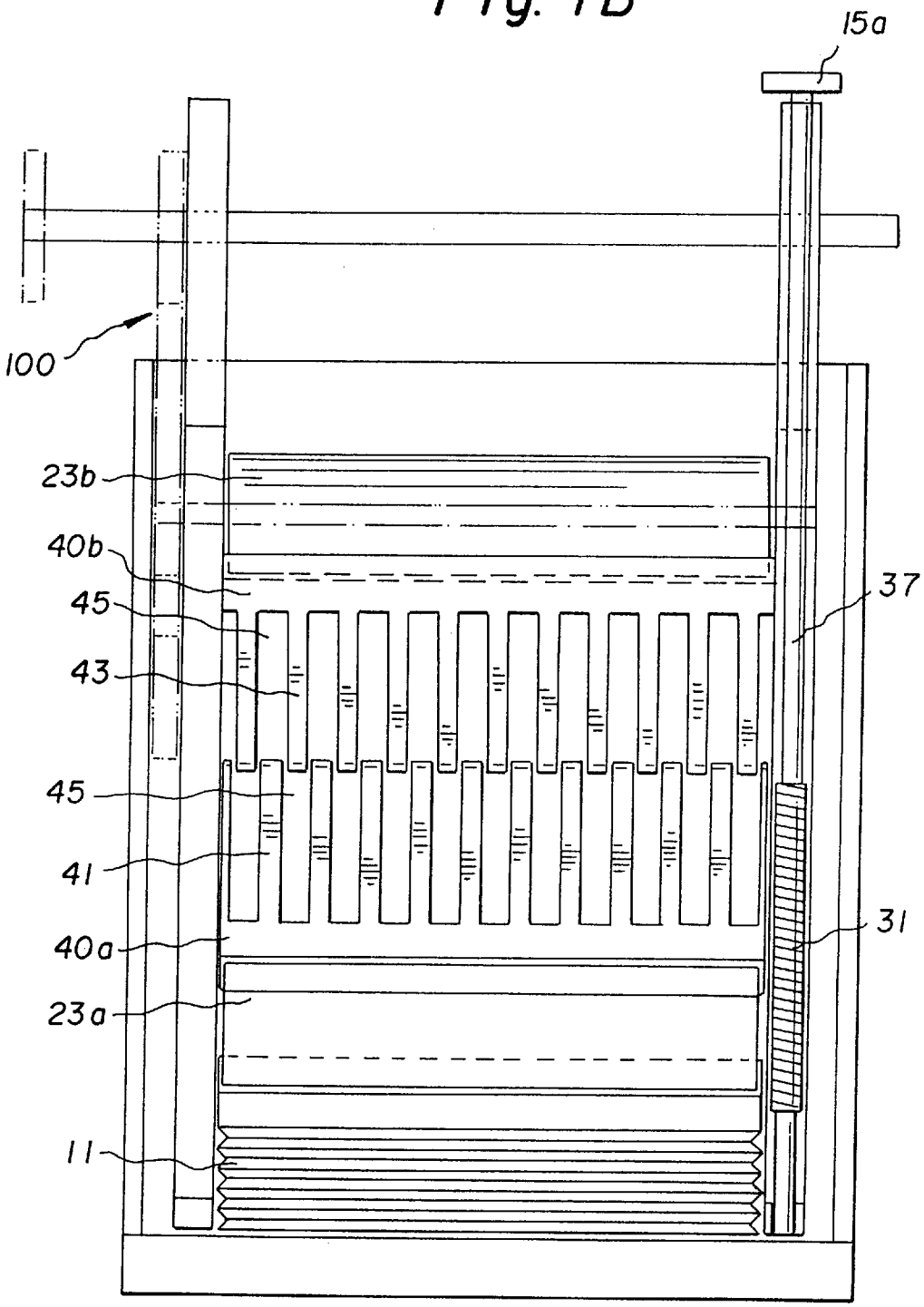
Figure 2B:
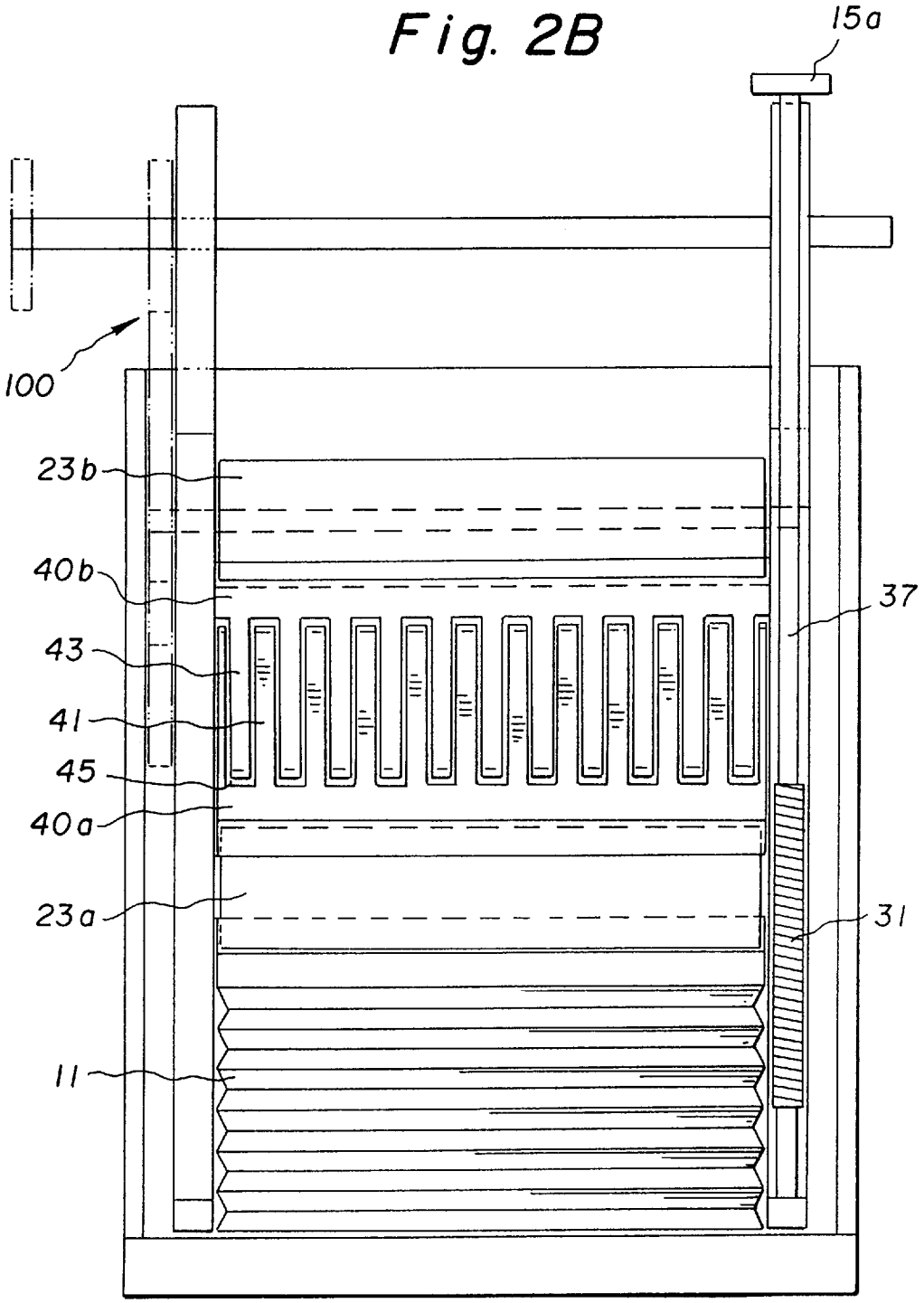
Figure 5:
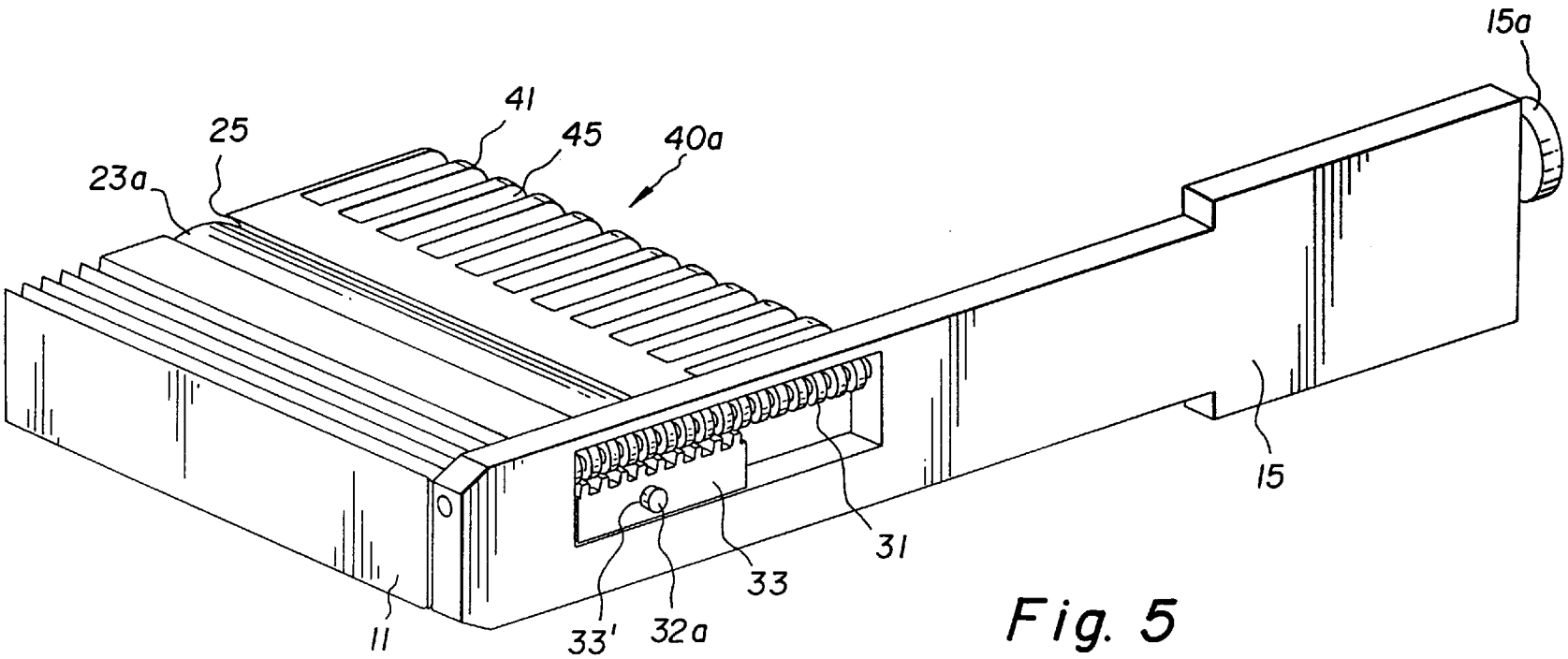
FIG. 5 is a view of the processing path length adjusting mechanism and an actuating mechanism of the present invention.

One example for actuating or causing the movement or expansion of path length adjusting mechanism 11 will now be described. FIG. 1B illustrates the position of path length adjusting mechanism 11 which corresponds to the position illustrated in FIG. 1A. As noted in FIGS. 1A, 1B and 5, the apparatus of the present invention can include a gearing arrangement which comprises at least one screw or worm gear 31 positioned at a side of tank 17. As illustrated in FIGS. 1B and 2B, screw gear 31 can be inserted next to a drive gear arrangement 100 which is utilized to drive rollers 23*a*–23*d*. As shown in FIG. 5, screw gear 31 can engage with a rack gear 33 having a hole 33'. A shaft 33*a* onto which the roller 23*a* is mounted extends through hole 33' of rack gear 33.

Screw gear 31 includes an extension part 37 which extends above rack 15 and ends in a handle 15*a*. The rack gear 33 is operationally associated with the shaft of the drive roller 23*a*, path length adjusting mechanism 11 and first member 40*a* such that a turning of handle 15*a* will cause a rotation of screw gear 31 engaged with rack gear 33 so as to move drive roller 33*a* and correspondingly move first member 40*a* and path length adjusting mechanism 11 to the position illustrated in FIGS. 2A and 2B and vice versa. It is recognized that alternative arrangements such as a pneumatic assembly or a different type of gear arrangement can be used instead of the disclosed screw and rack gear to achieve the described movement.

During the movement or expansion of path length adjusting mechanism 11, each of teeth-like members 41 and 43 are insertable into corresponding spaces 45 created by the teeth-like members 41 and 43 of each of the first and second members 40*a* and 40*b*. In the position illustrated in FIGS. 1A and 1B, teeth-like members 41 and 43 are not deeply inserted into spaces 45. When path length adjusting mechanism 11, first member 40*a* and drive roller 23*a* are moved to the position illustrated in FIGS. 2A and 2B, the bellows are expanded and the teeth-like members 41,43 are inserted into corresponding spaces 45. As described above, intermediate spacing member 40 maintains the proper spacing for processing path 21 and at the same time, minimizes the internal volume of tank 17 so as to require less processing solution. As a further feature of the present invention, it is noted that the use of a bellows for processing path length adjusting mechanism 11 also minimizes the internal volume of the tank 17. It is recognized that intermediate spacing member 40 is not limited to the disclosed configuration. It is noted that a collapsible flexible member which collapses upon the upward movement of path length adjusting member 11 can be used as an intermediate spacing member.

As illustrated in FIGS. 1A–1B and 2A–2B, processing path length adjusting mechanism 11 is shown as an expandable bellows. This is only one example and it is recognized that any movable, flexible or expandable member can be utilized as processing path length adjusting mechanism 11. For example, as one example, a piston and cylinder arrangement can be provided such that the piston is operationally connected to roller 23*a* and intermediate spacer member 40 and includes a curvature to define turnaround portion 21". Movement of the piston can be achieved in a known manner by using a pneumatic cylinder which can be, for example, mounted on the tank.

Figure 6A:
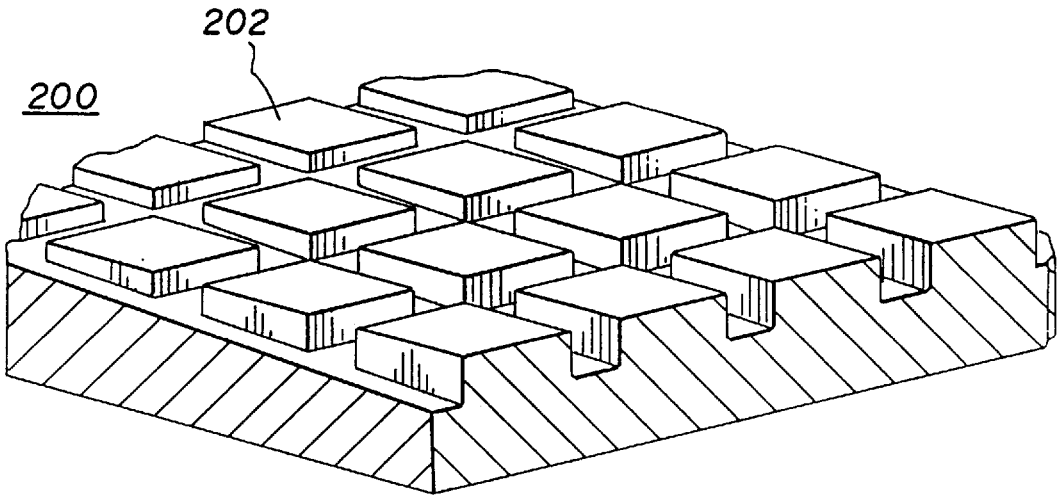
FIGS. 6A and 6B are examples of textured surfaces for the processing path of the present invention.
Figure 6B:
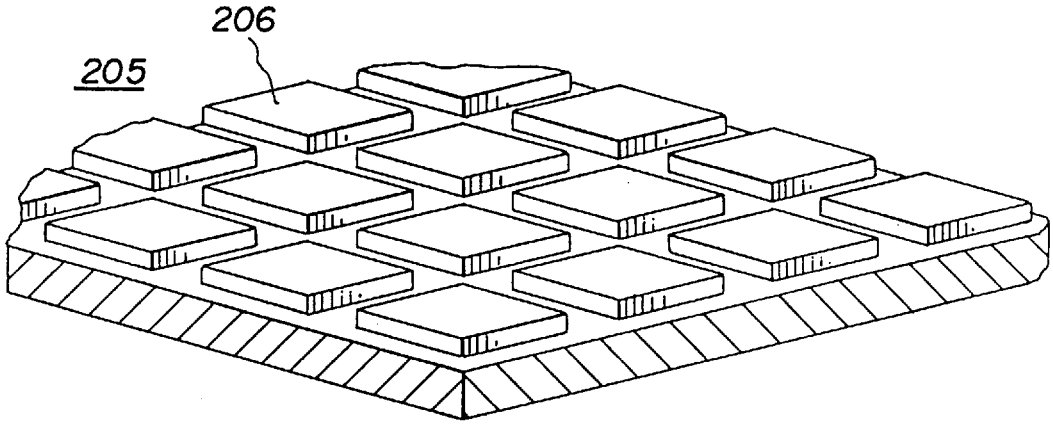

FIGS. 6A and 6B are perspective drawings of textured fluid-bearing surfaces 200 and 205 which can be located on one or both surfaces of processing path 21. Textured surfaces 200 and 205 are textured by any known process, e.g., knurling, molded, EDM electro-discharged machined or applied. Knurls 202 or 206 are respectively shown on surfaces 200 and 205. The texturing (FIGS. 6A,6B) and cantering (FIG. 6A) improve the flow of processing solution between the photosensitive material and the one or both surfaces of processing path 21, and prevent the photosensitive material from sticking on the surfaces.

The present invention can further include a control mechanism 50 to automatically actuate processing path length adjusting mechanism 11. For example, control mechanism 50 can include a computer or a central processing unit which is operationally connected to screw drive gear 31 by way of line 53. A plurality of desired predetermined lengths of the processing path can be inputted into the control mechanism 50. Therefore, if the user knows of the specific type of processing to be performed, he could input the desired processing path length into control mechanism 50 which is used for that particular type of photoprocessing. Control mechanism 50 can automatically actuate screw drive gear 31 to move path length adjusting mechanism 11 to the designated position along tank 17 so as to provide for the particular predetermined length of the processing path.

The invention has been described in detail with particular reference to certain preferred embodiments thereof, but it will be understood that variations and modifications can be effected within the spirit and scope of the invention.

What is claimed is:

1. A processing tank of a processor for processing photosensitive material, the processing tank comprising:

a processing path through which a photosensitive material to be processed travels; and a processing path length adjusting mechanism which forms a part of the processing path and adjusts a length of the processing path between at least a first predetermined length and a second predetermined length which is different than the first predetermined length, wherein said processing path length adjusting mechanism comprises an expandable member which is adjustable from a first position which defines the first predetermined length of the processing path to a second position which defines the second predetermined length of the processing path.

2. A processing tank according to claim 1, wherein said processing tank comprises a rack which is insertable and removable into and from the processing tank.

3. A processing tank according to claim 2, wherein said processing path length adjusting mechanism is located on said rack and within the tank upon the insertion of the rack within the tank.

4. A processing tank according to claim 1, further comprising an actuating mechanism which moves said processing path length adjusting mechanism between a first position which defines the first predetermined length of the processing path and a second position which defines the second predetermined length of the processing path.

5. A processing tank according to claim 4, wherein said actuating mechanism comprises a gear drive.

6. A processing tank according to claim 1, wherein said tank comprises a plurality of nozzle openings which supply processing solution to the tank, such that in the first position of said expandable member the nozzle openings are opened to supply the processing solution to the tank, and in the second position of the expandable member at least lower nozzle openings of said plurality of nozzle openings are blocked by said expandable member.

7. A processing tank according to claim 4, wherein said tank comprises a plurality of nozzle openings which supply processing solution to the tank, such that in the first position of said processing path length adjusting mechanism the nozzle openings are opened to supply processing solution to the tank, and in the second position of the processing path length adjusting mechanism, at least lower nozzle openings of said plurality of nozzle openings are blocked by said processing path length adjusting mechanism.

8. A processing tank according to claim 2, wherein said rack comprises a plurality of drive rollers, one of said drive rollers being connected to said processing path length adjusting mechanism so as to define a space between said one drive roller and a top surface of said processing path length adjusting mechanism, said space defining said part of said processing path.

9. A processing tank according to claim 8, wherein the top surface of said processing path length adjusting mechanism defines a curvature which corresponds to a curvature of said one drive roller.

10. A processing tank according to claim 8, wherein an intermediate spacer member is positioned between two of said drive rollers.

11. A processing apparatus comprising:

a processing section for processing a photosensitive material, said processing section comprising at least one processing tank containing processing solution therein and a processing path through which the photosensitive material passes; and an adjustment mechanism for controllably changing a length of the processing path so as to selectively provide for a plurality of different predetermined lengths, wherein said adjustment mechanism comprises a flexible member mounted in said processing tank which forms a part of said processing path, said flexible member being movable from a first position in which said processing path defines a first predetermined length to at least one further position in which said processing path defines a second predetermined length which is different than the first predetermined length.

12. A processing apparatus according to claim 11, wherein said processing tank comprises a plurality of nozzle openings for delivering processing solution to the processing tank.

13. A processing apparatus according to claim 12, wherein in said first position of said flexible member the nozzle openings are opened to deliver the processing solution to the processing tank, and in said further position of the flexible member at least lower nozzle openings of said plurality of nozzle openings are blocked by said flexible member.

14. An apparatus for changing a length of a processing path in a processing tank of a processor which processes photosensitive material, the apparatus comprising:

a flexible member mounted in the processing tank which forms a part of the processing path, said flexible member being selectively adjustable to a plurality of positions within said processing tank that each define a different length of the processing path; and an actuating mechanism for moving the flexible member between said plurality of positions.

15. An apparatus according to claim 14, wherein said flexible member comprises a bellows.

16. A method of adjusting a length of a processing path for photosensitive material within a processing tank, the method comprising the steps of:

positioning a flexible member in the processing tank so as to form a part of the processing path; and moving said flexible member to one of a plurality of different predetermined positions along the processing tank so as to change a length of the processing path, wherein each of said plurality of different predetermined positions defines a different length for the processing path.

17. A method according to claim 16, wherein said flexible member is a bellows.

18. A method according to claim 16, wherein said part of the processing path is defined by a spacing between the flexible member and a drive roller positioned in said processing tank.

19. A method according to claim 16, wherein said processing tank comprises a plurality of nozzle openings which supply processing solution to the processing tank, such that said step of moving said flexible member comprises the step of moving said flexible member so as to block at least lower nozzle openings of said plurality of nozzle openings.

20. A method according to claim 16, wherein said processing tank is part of a processing apparatus for processing photosensitive material.

* * * * *